US007367139B2

(12) United States Patent
Ando et al.

(10) Patent No.: US 7,367,139 B2
(45) Date of Patent: May 6, 2008

(54) VACUUM PROCESSING APPARATUS AND METHOD OPERATION THEREOF

(75) Inventors: Yasunori Ando, Kyoto (JP); Masatoshi Onoda, Kyoto (JP)

(73) Assignee: Nissin Ion Equipment Co., Ltd., Kyoto (JP)

( * ) Notice: Subject to any disclaimer, the term of this patent is extended or adjusted under 35 U.S.C. 154(b) by 0 days.

(21) Appl. No.: 11/454,875

(22) Filed: Jun. 19, 2006

(65) Prior Publication Data

US 2006/0283041 A1 Dec. 21, 2006

(30) Foreign Application Priority Data

Jun. 20, 2005 (JP) ..... P.2005-179270

(51) Int. Cl.
*F26B 5/04* (2006.01)
*F26B 19/00* (2006.01)

(52) U.S. Cl. ..... 34/406; 34/417; 34/92; 34/209; 34/242; 414/939

(58) Field of Classification Search ..... 34/406, 34/417, 92, 209, 242; 414/217, 935, 939; 432/242

See application file for complete search history.

(56) References Cited

U.S. PATENT DOCUMENTS 5,989,346 A * 11/1999 Hiroki ..... 414/935
6,142,773 A * 11/2000 Shimazu ..... 432/242
6,658,762 B2 * 12/2003 Chang et al. ..... 414/939

FOREIGN PATENT DOCUMENTS

| | | |
|---|---|---|
| JP | 7-211763 | 8/1995 |
| JP | 07-211763 | 11/1995 |
| JP | 11-050256 | 2/1999 |
| JP | 2004-007014 | 1/2004 |
| JP | 2004-182475 | 7/2004 |
| JP | 2004-535671 | 11/2004 |
| KR | 10-2003-0001095 A | 6/2003 |
| WO | WO-03/005413 A2 | 1/2003 |

OTHER PUBLICATIONS

Korean Office Action dated Jul. 20, 2007, for Patent Application No. 10-2006-0055381.

* cited by examiner

*Primary Examiner*—Jiping Lu
(74) *Attorney, Agent, or Firm*—Finnegan, Henderson, Farabow, Garrett & Dunner, L.L.P.

(57) ABSTRACT

This vacuum processing apparatus has a fixed processing chamber 24 and two movable load lock chambers 28*a* and 28*b*. A gate valve 26 is provided on the processing chamber 24, and gate valves 30 are respectively provided on the load lock chambers 28*a* and 28*b*. Each of the load lock chambers 28*a* and 28*b* is moved in a Y direction by a preparatory chamber moving mechanism 34. A vacuum seal 54, which is expandable and shrinkable so as to vacuum seal a gap G between the gate valves 26 and 30 which are set close to each other during the expansion, is provided around a peripheral edge portion of the processing chamber gate valve 26. Further, a substrate transporting mechanism for transporting a substrate 2 between the processing chamber 24 and each of the load lock chambers 28*a* and 28*b* set close thereto.

12 Claims, 8 Drawing Sheets

VACUUM PROCESSING APPARATUS AND METHOD OPERATION THEREOF

TECHNICAL FIELD

The present disclosure relates to a vacuum processing apparatus and a method of operation thereof for providing processing to a substrate in a vacuum atmosphere, such as a plasma CVD apparatus, a thin-film forming apparatus such as a sputtering apparatus, an etching apparatus, an aligning apparatus for alignment processing of the aligned film of a liquid crystal, an ion implantation apparatus, an ion doping apparatus, and the like.

RELATED ART

As a vacuum processing apparatus aimed at a high rate of operation, a so-called multi-chamber type vacuum processing apparatus having a plurality of vacuum chambers has hitherto been proposed. One of such examples is shown in FIG. 8.

This vacuum processing apparatus has a structure in which a transport chamber 10 is disposed in a central portion, and two processing chambers 14 and two load lock chambers 18 are disposed in its vicinities. Since all of the transport chamber 10, the processing chambers 14, and the load lock chambers 18 are evacuated to a vacuum, they can be generically called vacuum chambers. These vacuum chambers 10, 14, and 18 are disposed in a horizontal plane (in an X-Y plane in the illustrated example).

The transport chamber 10 has in its interior a substrate transporting mechanism 12 for transporting a substrate 2 in the X direction shown by arrows A and in the Y direction shown by arrows B in this example. The substrate 2 has, for example, a rectangular shape. In this example, the substrate 2 is transported in an upright state (see FIG. 7).

The processing chamber 14 is a chamber for providing the substrate 2 with processing such as thin-film formation, etching, alignment processing, and ion doping. A gate valve 16 is provided between each of the respective processing chambers 14 and the transport chamber 10.

The load lock chamber 18 is a vacuum chamber for allowing the substrate 2 to enter and exit to and from the transport chamber 10 with respect to the atmosphere without opening the transport chamber 10 to the atmosphere. A gate valve 20 is provided between each load lock chamber 18 and the transport chamber 10, and a gate valve 22 is provided between each load lock chamber 18 and the atmosphere.

In the above-described multi-chamber type vacuum processing apparatus, it is possible to concurrently perform a plurality of operations (e.g., the processing of the substrate 2 and the transport of the substrate 2). Further, in a case where two processing chambers 14 for performing the same processing are provided, while processing is being performed in one processing chamber 14, maintenance or the like can be performed in the other processing chamber 14, thereby making it possible to obviate the stopping of the apparatus. For these reasons, it is possible to realize a high rate of operation.

It should be noted that a vacuum processing apparatus having a substantially similar construction is also disclosed in Japanese Patent Unexamined Publication No. Hei. 7-211763 (paragraph 0002-0007, FIG. 1). Namely, a vacuum processing apparatus (multi-chamber apparatus) having a construction in which processing chambers (process chambers) and load lock chambers are disposed in the vicinities of a transport chamber (wafer transport chamber) is disclosed.

In recent years, the tendency toward large-sized substrates 2 is underway, so that the tendency toward large-sized load lock chambers 10, 14, and 18 is noticeable. For example, in the case of the substrate 2 for a flat panel display (FPD) such as a liquid crystal display, the length of its short side is as large as 1500 mm to 1870 mm or thereabouts, and the length of its long side is as large as 1850 mm to 2200 mm or thereabouts. Therefore, the aforementioned vacuum chambers 10, 14, and 18 become very large-sized since the lateral length of the substrate 2 is very large not only in the case where the substrate 2 is accommodated in a prostrate state but also in the case where the substrate 2 is accommodated in an upright state as in this example. In consequence, there is a problem in that the area of installation of the vacuum processing apparatus is very large.

In addition, in conjunction with the tendency toward the large-sized load lock chambers 18, their evacuation time also becomes long, and there is another problem in that this constitutes a factor causing a decline in the throughput (processing capacity per unit time) of the vacuum processing apparatus.

SUMMARY

The disclosure below describes a vacuum processing apparatus and a method of operation thereof which can make small the installation area of the vacuum processing apparatus having a plurality of vacuum chambers. The disclosure also describes a vacuum processing apparatus and a method of operation thereof which can improve the throughput of the vacuum processing apparatus.

An example implementation of the invention is described below. One vacuum processing apparatus comprises: a processing chamber to provide processing to a substrate; a processing chamber gate valve installed on the processing chamber and capable of allowing the substrate to pass therethrough; a plurality of movable load lock chambers; a plurality of preparatory chamber gate valves, each of which is installed on the corresponding load lock chamber and capable of allowing the substrate to pass therethrough; a preparatory chamber moving mechanism for moving the load lock chambers individually or in an interlocking relation so that the processing chamber gate valve and the preparatory chamber gate valve approach each other or move away from each other; a vacuum sealing portion which is provided in a peripheral edge portion of the processing chamber gate valve and is expandable and shrinkable, to vacuum seal a gap between the processing chamber gate valve and the preparatory chamber gate valve which are set close to each other during expansion; a substrate transporting mechanism for transporting the substrate between the processing chamber and the load lock chamber through the both gate valves and the vacuum sealing portion in a state in which the processing chamber gate valve and the preparatory chamber gate valve are set close to each other; an evacuating section for evacuating each of the load lock chambers; and a venting section for venting each of the load lock chambers.

Another vacuum processing apparatus comprises: a plurality of processing chambers to provide processing to a substrate; a plurality of processing chamber gate valve, each of which is installed on the corresponding processing chamber and capable of allowing the substrate to pass therethrough; a plurality of movable load lock chambers; a plurality of preparatory chamber gate valve, each of which is installed on the corresponding load lock chamber and capable of allowing the substrate to pass therethrough; a preparatory chamber moving mechanism for moving the load lock chambers individually or in an interlocking relation so that the processing chamber gate valve and the preparatory chamber gate valve approach each other or move away from each other; a plurality of vacuum sealing portions, each of which is provided in a peripheral edge portion of the corresponding processing chamber gate valve and is expandable and shrinkable, to vacuum seal a gap between the processing chamber gate valve and the preparatory chamber gate valve which are set close to each other during expansion; a substrate transporting mechanism for transporting the substrate between the processing chamber and the load lock chamber through the both gate valves and the vacuum sealing portion in a state in which the processing chamber gate valve and the preparatory chamber gate valve are set close to each other; an evacuating section for evacuating each of the load lock chambers; and a venting section for venting each of the load lock chambers.

According to the above-described vacuum processing apparatus, it is possible to move a desired load lock chamber among the plurality of load lock chambers by a preparatory chamber moving mechanism, to couple that load lock chamber and the processing chamber by means of the preparatory chamber gate valve and the processing chamber gate valve and in a state of being vacuum sealed by the vacuum sealing portion, and to transport the substrate between that load lock chamber and the processing chamber by the substrate transporting mechanism. Accordingly, it becomes unnecessary to provide a transport chamber that is required in the related art.

The vacuum processing apparatus may further comprise: a second evacuating section for evacuating a space surrounded by the vacuum sealing portion is evacuated; and a second venting section for venting that space.

An atmosphere-side gate valve for partitioning the respective load lock chamber and the atmosphere maybe provided on a side surface of the load lock chamber opposite to a side surface thereof where the preparatory chamber gate valve is provided.

Each of the load lock chambers may be capable of accommodating a plurality of substrates in its interior.

The substrate may be transported by being held on a tray for holding the substrate.

A method of operating the vacuum processing apparatus comprises the steps of: coupling one of the plurality of load lock chambers and the processing chamber in a state of being vacuum sealed by the vacuum sealing portion; and concurrently with the operation of replacing the substrate between the both chambers, performing operations of the venting of the load lock chamber, the replacement of the substrate between the load lock chamber and the atmosphere, and the evacuation of the load lock chamber in at least one of the remaining load lock chambers.

Another method of operating the vacuum processing apparatus comprises the steps of: performing in one of the plurality of load lock chambers the operations of the venting of that load lock chamber, the replacement of the substrate between that load lock chamber and the atmosphere, and the evacuation of that load lock chamber; and concurrently performing, by using at least one of the remaining load lock chambers, the operations of carrying out the substrate processed in the one of the plurality of processing chambers from that processing chamber and of carrying that substrate into another processing chamber.

Various implementations may include one or more the following advantages. For example, a desired load lock chamber among the plurality of load lock chambers is moved, that load lock chamber and the processing chamber are coupled to each other in a state of being vacuum sealed by the vacuum sealing portion, and the substrate can be transported between that load lock chamber and the processing chamber. Therefore, it becomes unnecessary to provide a transport chamber which has hitherto been required. As a result, the installation area of this vacuum processing apparatus can be made small.

Moreover, although it has hitherto been necessary to transport the substrate via the transport chamber having the substrate transporting mechanism in its interior, and particles (contaminants) are produced from the substrate transporting mechanism and have been likely to adhere to the substrate surface. In this invention, however, since the substrate can be transported without via such a transport chamber, it is possible to reduce the particles adhering to the surface of the substrate.

In addition, the respective load lock chambers can be evacuated by the evacuating section during the movement of the respective load lock chambers, thereby making it possible to effectively use the time. Accordingly, the effect exerted by the time required for evacuation on the throughput of the vacuum processing apparatus can be made small, making it possible to improve the throughput of the vacuum processing apparatus.

Further, since a plurality of processing chambers are provided, it is possible to provide various processing with respect to the substrate. In addition, since a greater number of operations can be performed concurrently, and it becomes possible to easily obviate the stopping of the operation of all the processing chambers, it is possible to realize a higher rate of operation of the vacuum processing apparatus.

Further, by using the second evacuating section and the second venting section, differential pressure can be prevented from being applied across the both gate valves during the opening and closing of the processing chamber gate valve and the preparatory chamber gate valve, so that a further advantage is offered in that the opening and closing of the both gate valves can be facilitated.

Further, since the preparatory chamber gate valve can be used in the transport of the substrate between the load lock chamber and the processing chamber, and the atmosphere-side gate valve can be used in the transport of the substrate between the load lock chamber and the atmosphere, a still further advantage is offered in that the transport of the substrate can be effected more easily and more speedily.

Further, since a plurality of substrates can be accommodated in the load lock chamber, it is possible to reduce the frequency at which the load lock chamber is opened to the atmosphere to transport the substrate with respect to the atmosphere, and it is possible to perform the replacement of the substrate with respect to the processing chamber more speedily. Accordingly, a further advantage is offered in that it is possible to improve the throughput of the vacuum processing apparatus further.

Further, since the substrate is transported in the state of being held on the tray, a further advantage is offered in that the transport of the substrate is facilitated. In particular, the transport of a thin and large-sized substrate in an upright state is facilitated.

Further, since the operation of replacing the substrate between one load lock chamber and the processing chamber and the operation of such as replacing the substrate between another load lock chamber and the atmosphere are performed concurrently, it is possible to reduce wasteful waiting time. In consequence, the throughput of the vacuum processing apparatus improves.

Further, since the operation of such as replacing the substrate between one load lock chamber and the atmosphere and the operation of transporting the substrate between the plurality of processing chambers by using another load lock chamber are performed concurrently, it is possible to reduce wasteful waiting time. In consequence, the throughput of the vacuum processing apparatus improves.

Other features and advantages may be apparent from the following detailed description, the accompanying drawings and the claims.

DETAILED DESCRIPTION

Figure 1:
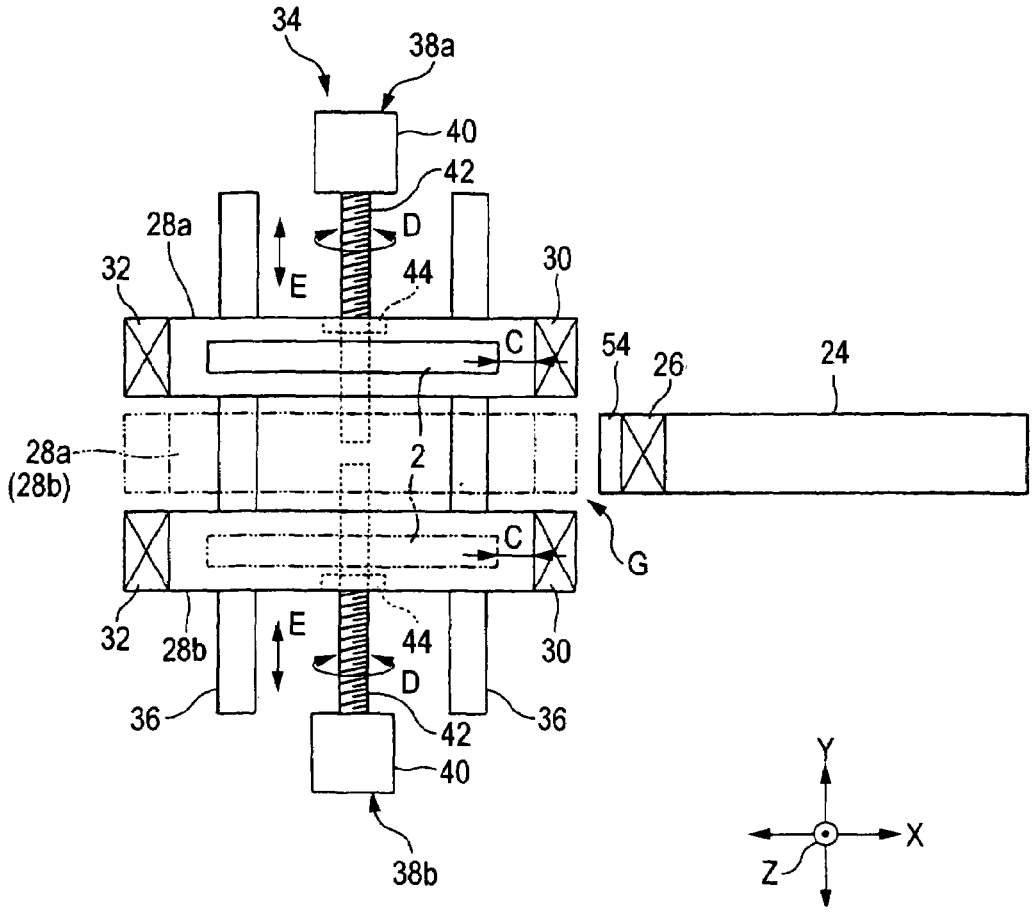
FIG. 1 is a schematic plan view illustrating an embodiment of a vacuum processing apparatus in accordance with the invention.

FIG. 1 is a schematic plan view illustrating an embodiment of a vacuum processing apparatus in accordance with this invention. To put it simply, this vacuum processing apparatus is not provided with a transport chamber which the related-art vacuum processing apparatus had, and load lock chambers 28*a* and 28*b* and a processing chamber 24 for performing the processing of a substrate 2 are made mechanically separate and independent, such that the load lock chambers 28*a* and 28*b* are movable, and the load lock chambers 28*a* and 28*b* and the processing chamber 24 are connectable and disconnectable.

The substrate 2 has, for example, a rectangular shape. As for the size of the substrate 2, referring to FIG. 7, the length $L_1$ of its short side is 1500 mm to 1870 mm or thereabouts, and the length $L_2$ of its long side is 1850 mm to 2200 mm or thereabouts.

Figure 2:
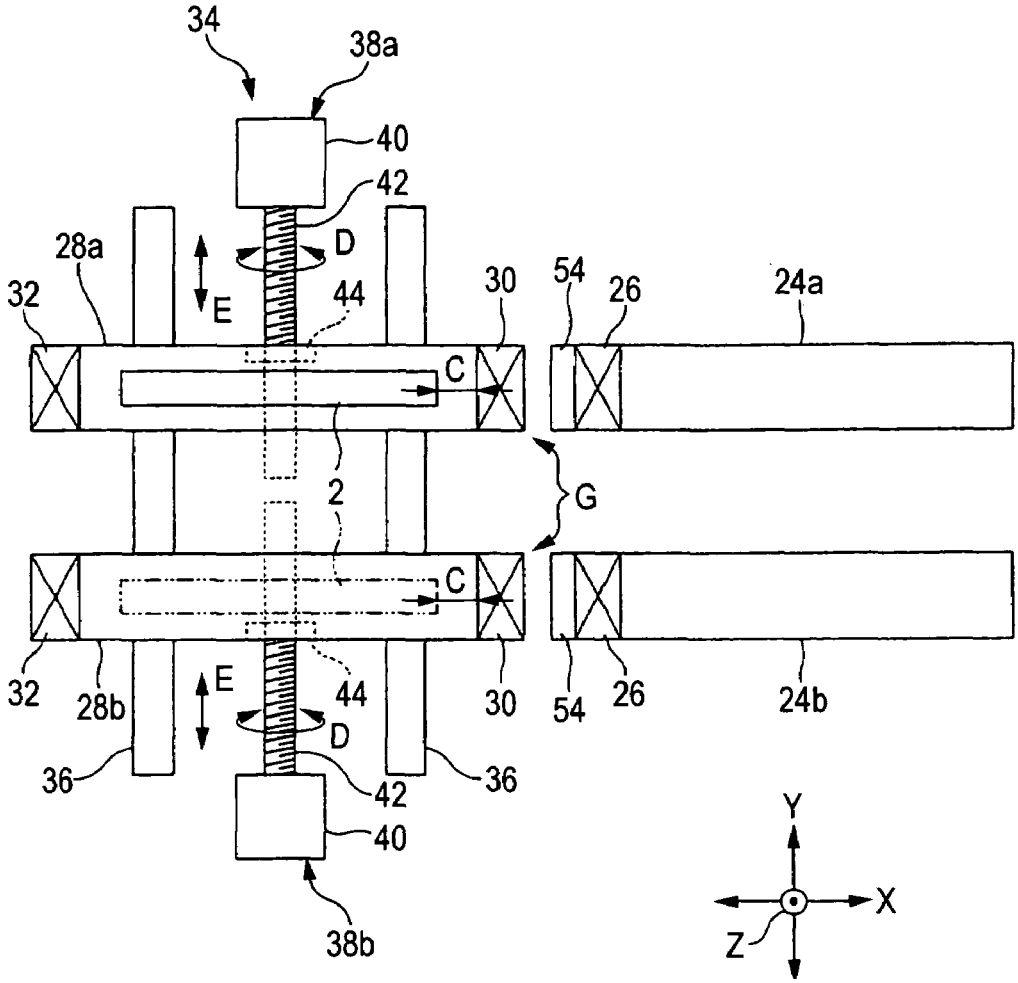
FIG. 2 is a schematic plan view illustrating another embodiment of the vacuum processing apparatus in accordance with the invention.

This vacuum processing apparatus handles (e.g., transports) the above-described rectangular substrate 2 in an upright state. The same applies to another embodiment shown in FIG. 2.

Figure 7:
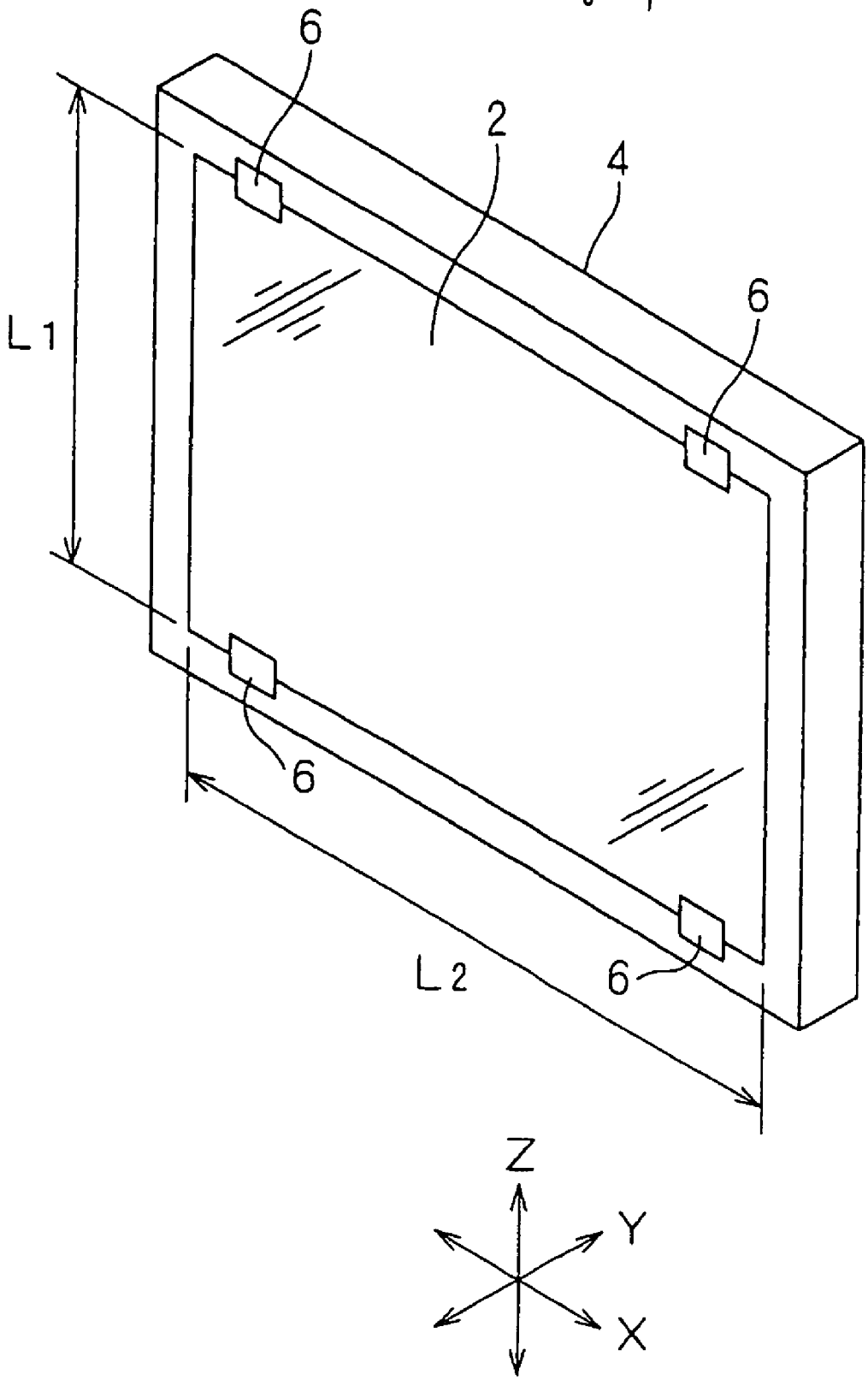
FIG. 7 is a perspective view illustrating an example of a state in which a substrate is held on a tray.
Figure 8:
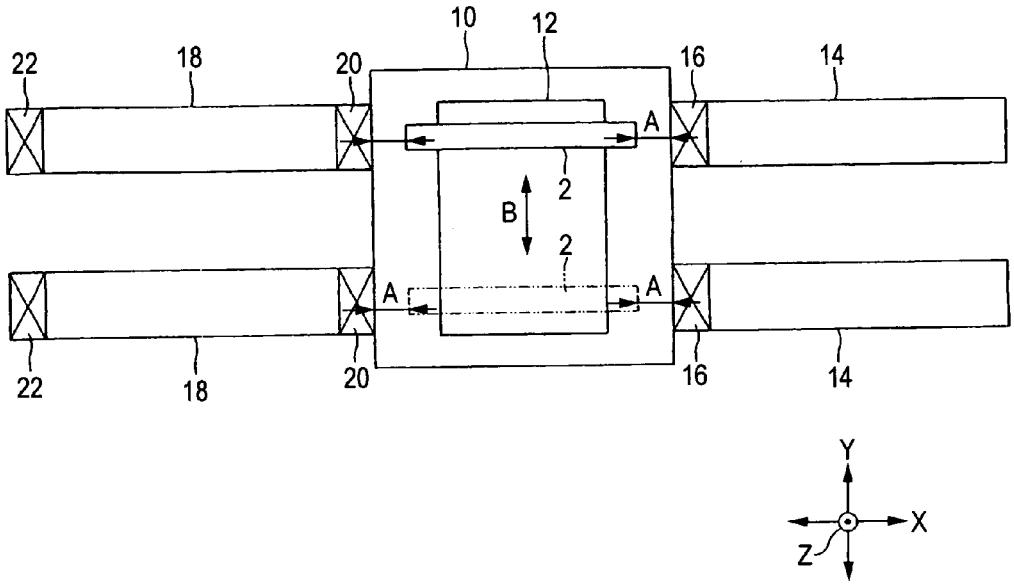
FIG. 8 is a schematic plan view illustrating an example of a related-art vacuum processing apparatus.

The substrate 2 may be held on a tray 4 of such as the example shown in FIG. 7, by using clampers 6 or the like, and may be transported in that state. By so doing, the transport of the substrate 2 is facilitated. In particular, a thin and large-sized substrate 2 can be easily transported in the upright state. However, the substrate 2 may be transported without using the tray 4 or by using a means other than the tray 4. In a case where the substrate 2 is transported in a horizontal state, the tray 4 is not used in many cases.

It should be noted that, as for the substrate 2, only the substrate 2 is illustrated and a description of its transport is given in FIGS. 1 to 6 and in their descriptions. However, in the case where the tray 4 is used, the substrate 2 is transported in a state of being held on the tray 4. Accordingly, gate valves 26 and 30, a vacuum seal 54 and the like, which will be described later, allow the tray 4 holding the substrate 2 to be passed therethrough, while a substrate transporting mechanism 72 transports the tray 4 holding the substrate 2.

To describe in full detail the vacuum processing apparatus shown in FIG. 1, this vacuum processing apparatus has one fixed processing chamber 24 and a plurality of (in this embodiment, two) load lock chambers 28*a* and 28*b*. Since all of the processing chamber 24 and the load lock chambers 28*a* and 28*b* are evacuated to a vacuum, they can be generically called vacuum chambers. These vacuum chambers 24, 28*a*, and 28*b* are shaped in the form of rectangular parallelepipeds which are upright in a Z direction (vertical direction). These vacuum chambers are arranged in a horizontal plane (in an X-Y plane in the illustrated example).

The processing chamber 24 is a chamber for providing the substrate 2 with processing such as, thin film formation, etching, alignment processing, and ion doping, and is evacuated by an unillustrated vacuum pump (evacuating section). The processing chamber gate valve 26, which is a valve for partitioning inner and outer sides of the processing chamber 24 and allows the substrate 2 to pass therethrough, is provided on one side surface of this processing chamber 24. The same applies to processing chambers 24*a* and 24*b* as well.

The load lock chambers 28*a* and 28*b* are vacuum chambers for allowing the substrate 2 to enter and exit to and from the processing chamber 24 with respect to the atmosphere without opening the processing chamber 24 to the atmosphere. The preparatory chamber gate valves 30, which are valves for partitioning the inner and outer sides of the both load lock chambers 28*a* and 28*b* and allow the substrate 2 to pass therethrough, are respectively provided on the processing chamber 24 side surfaces of the load lock chambers 28*a* and 28*b*.

In this embodiment, atmosphere-side gate valves 32, which are valves for partitioning the load lock chambers 28*a* and 28*b* and the atmosphere and allow the substrate 2 to pass therethrough, are respectively provided on side surfaces of the load lock chambers 28*a* and 28*b* opposite to the side surfaces thereof where the preparatory chamber gate valves 30 are provided. If these atmosphere-side gate valves 32 are provided, the preparatory chamber gate valves 30 can be used for the transport of the substrate 2 to and from the processing chamber 24, and the atmosphere-side gate valves 32 can be used for the transport of the substrate 2 between each of the load lock chambers 28*a* and 28*b* and the atmosphere. Therefore, the transport of the substrate 2 can be performed more easily and more speedily. In addition, by closing the both gate valves 30 and 32, the load lock chambers 28*a* and 28*b* can be moved while maintaining the vacuum of the load lock chambers 28*a* and 28*b*.

This vacuum processing apparatus further has a preparatory chamber moving mechanism 34 for moving the load lock chambers 28*a* and 28*b* in Y directions, as shown by arrows E, such that the processing chamber gate valve 26 provided in the processing chamber 24 and the preparatory chamber gate valves 30 provided in the load lock chambers 28*a* and 28*b* approach each other with a gap G provided therebetween (the state shown by the two-dot chain lines in FIG. 1) or move away from each other (the state shown by the solid lines in FIG. 1).

Namely, the preparatory chamber moving mechanism 34 moves the load lock chambers 28*a* and 28*b* to cause them to approach the processing chamber 24 so as to be aligned with the processing chamber 24 in an X direction, i.e., the longitudinal direction of the load lock chambers 28*a* and 28*b*, or to move away from the processing chamber 24 in the Y direction perpendicular to the X direction.

The preparatory chamber moving mechanism 34 in this embodiment individually moves the both load lock chambers 28*a* and 28*b*, and has two rectilinear guide rails 36 extending in the Y direction with a predetermined interval provided therebetween in the X direction, guides 37 (see FIGS. 5 and 6) for supporting the load lock chambers 28*a* and 28*b* movably on these guide rails 36, and drive mechanisms 38*a* and 38*b* for respectively moving the load lock chambers 28*a* and 28*b*.

The drive mechanism 38*a* has a reversible motor 40, a ball screw 42 connected to this motor 40, and a ball nut 44 threadedly engaged with this ball screw 42 and mounted in the load lock chamber 28*a*. As the ball screw 42 is rotated clockwise and counterclockwise, as shown by arrows D, by the motor 40, the load lock chamber 28*a* can be reciprocated in the Y directions, as shown by the arrows E. The drive mechanism 38*b* also has a structure similar to the above-described drive mechanism 38*a*, and is capable of reciprocating the load lock chamber 28*b* in the Y directions, as shown by the arrows E. The distance of moving the respective load lock chambers 28*a* and 28*b* is, for example, 0.5 m to 2 m or thereabouts.

However, the preparatory chamber moving mechanism 34 may be arranged to move the both load lock chambers 28*a* and 28*b* in a mutually interlocking relation (i.e., synchronously). Still alternatively, it is also possible to adopt an arrangement in which the two load lock chambers 28*a* and 28*b* are coupled to each other, and are simultaneously moved by the preparatory chamber moving mechanism 34. Further, one load lock chamber which is moved by the preparatory chamber moving mechanism 34 may be internally divided into two parts to form two load lock chambers corresponding to the aforementioned load lock chambers 28*a* and 28*b*. Still further, the guide rails 36 may not necessarily be rectilinear, and may be curvilinear, for example.

The vacuum seal 54 is provided around a peripheral edge portion of the processing chamber gate valve 26, more specifically around the peripheral edge portion of the preparatory chamber gate valve 30. The vacuum seal 54 constitutes a vacuum seal means which is expandable and shrinkable so as to vacuum seal the gap G between the preparatory chamber gate valve 30 of the load lock chamber 28*a* or 28*b* and the processing chamber gate valve 26 which are set close to each other, as described above, during the expansion.

Figure 3:
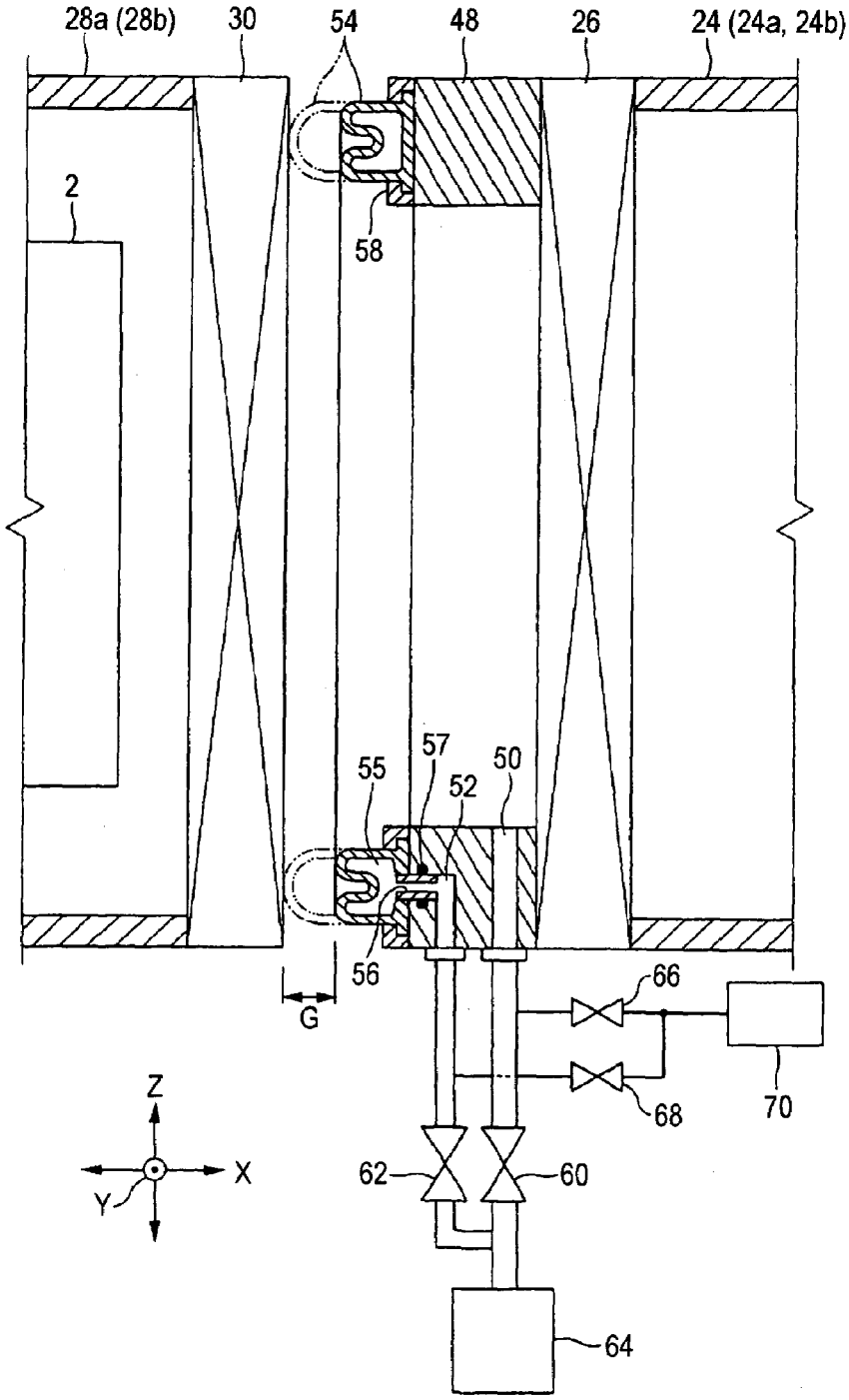
FIG. 3 is a cross-sectional view illustrating in an enlarged form a specific example of the structure of a vacuum seal and its periphery shown in FIGS. 1 and 2.

A specific example of the structure of this vacuum seal 54 and its periphery is shown in FIG. 3. The vacuum seal 54 in this example is installed at the peripheral edge portion of the processing chamber gate valve 26 with a flange 48 interposed therebetween. Namely, the flange 48 is installed on the gap G side surface of the processing chamber gate valve 26, and the vacuum seal 54 is installed on the gap G side surface of this flange 48 by means of fixing members 58. In this example, the vacuum seal 54 and the flange 48 are formed in the shape of rectangular loops (i.e., picture frames), and the substrate 2 is passed therethrough. It should be noted that in the drawings other than FIG. 3 the illustration of the flange 48 is omitted to simplify the illustration.

The vacuum seal 54 is a hollow gasket made of cloth-reinforced rubber or rubber itself and is expandable and shrinkable. Namely, if pressure is supplied to its hollow portion 55, e.g., if compressed air is supplied thereto, the vacuum seal 54 expands, as shown by the two-dot chain lines in FIG. 3, and its distal end portion is pressed against the preparatory chamber gate valve 30 which is close thereto, as described above, thereby hermetically sealing (vacuum sealing) the gap G. Meanwhile, if the pressure within the hollow portion 55 is set to negative pressure, e.g., if the hollow portion 55 is evacuated, the vacuum seal 54 shrinks, as shown by the solid lines in FIG. 3, and its distal end portion moves away from the preparatory chamber gate valve 30, thereby making it possible to form the gap G. The dimension of the gap G is, for example, 5 mm or thereabouts.

The vacuum seal 54 in this example has a ferrule 56, and the ferrule 56 communicates with an orifice 52 provided in the flange 48. Reference numeral 57 denotes a packing such as an O-ring. In this example, compressed air from a compressed air source 70 is supplied to the hollow portion 55 of the vacuum seal 54 via a valve 68 and the orifice 52. In addition, the hollow portion 55 of the vacuum seal 54 is evacuated by a vacuum pump 64 via the orifice 52 and a valve 62.

The aforementioned vacuum seal 54 is, for example, INFLATE Seal (registered trademark) made by NIPPON VALQUA INDUSTRIES, LTD.

Another orifice 50 is provided in the flange 48. The arrangement provided is such that an evacuating section for evacuating the space surrounded by the vacuum seal 54 and the flange 48 is formed by using this orifice 50, a valve 60, and the aforementioned vacuum pump 64. In addition, a venting section for venting the space surrounded by the vacuum seal 54 and the flange 48 by supplying air into that space is formed by using the orifice 50, the valve 66, and the aforementioned compressed air source 70. In this specification, the term "vent" refers to setting the space held in the state of vacuum into a state of atmospheric pressure by introducing a gas (e.g., air, nitrogen gas, etc.) into it.

It should be noted that the vacuum seal 54 may be installed on the processing chamber gate valve 26 without providing the flange 48. In that case, it suffices if portions corresponding to the aforementioned orifices 50 and 52 are provided in the end portion of the processing chamber gate valve 26, as required. In this case, the above-described evacuating section evacuates the space surrounded by the vacuum seal 54, and the above-described venting section vents that space.

By using the evacuating section and the venting section, the pressure of the space surrounded by the vacuum seal 54 and the flange 48 (or the space surrounded by the vacuum seal 54 in the case where the flange 48 is not provided) can be set to be substantially equal to the pressure within the processing chamber 24 and within the load lock chamber 28*a* or 28*b* during the opening of the preparatory chamber gate valve 30. Since differential pressure can thus be prevented from being applied across the both gate valves 26 and 30, the opening and closing of the both gate valves 26 and 30 can be facilitated.

Figure 4:
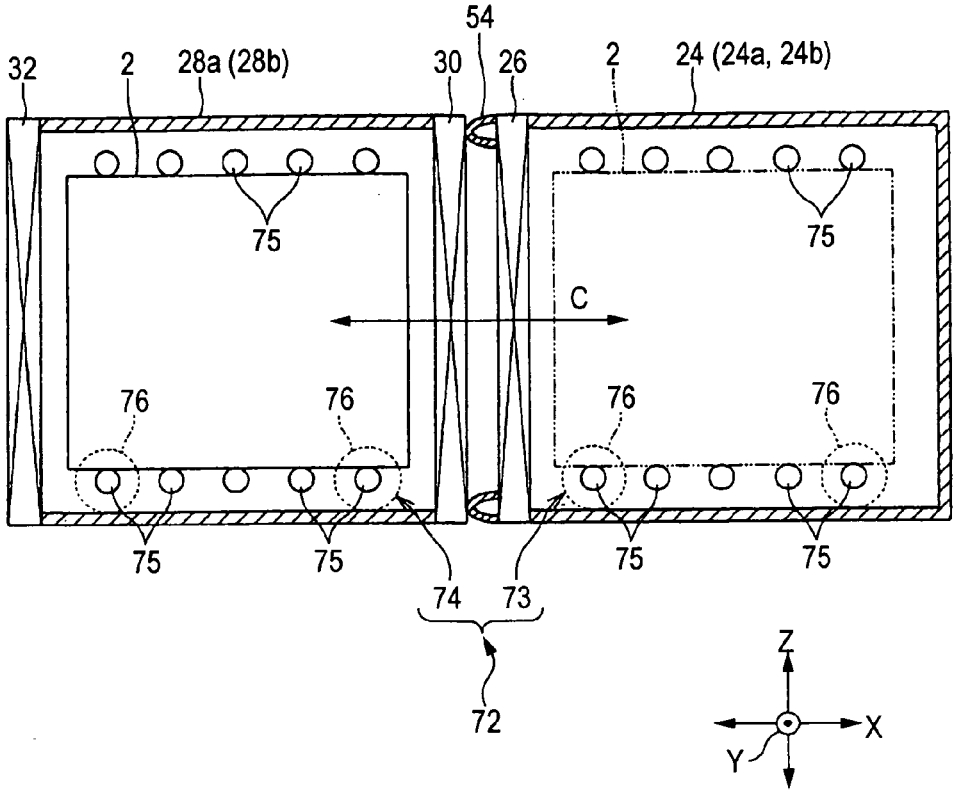
FIG. 4 is a schematic cross-sectional view illustrating an example of a substrate transporting mechanism.

This vacuum processing apparatus further has the substrate transporting mechanism 72 for transporting the substrate 2 in the X directions, as shown by arrows C, between the processing chamber 24 and the load lock chamber 28*a* or 28*b* through the both gate valves 26 and 30 and the vacuum seal 54 in the state in which the processing chamber gate valve 26 and the preparatory chamber gate valve 30 are set close to each other, as in the example shown in FIG. 4.

The substrate transporting mechanism 72 has a roller mechanism 73 provided in the processing chamber 24 and roller mechanisms 74 respectively provided in the load lock chambers 28*a* and 28*b*. Each of the roller mechanisms 73 and 74 has a plurality of rollers 75 for supporting and moving the substrate 2. A number of rollers among them, e.g., the rollers 75 located at both ends in the respective chambers 24, 28*a*, and 28*b*, are respectively driven by driving sources 76.

The replacement (entry and exit) of the substrate 2 between each of the load lock chambers 28*a* and 28*b* and the processing chamber 24 is performed as follows, for example: A desired load lock chamber (e.g., the load lock chamber 28*a*) is moved alongside the processing chamber 24, and in the state in which the processing chamber gate valve 26 and the preparatory chamber gate valve 30 are set close to each other, the vacuum seal 54 is expanded to close the gap G. In this state, the space surrounded by the vacuum seal 54 and the like is evacuated. Then, the both gate valves 26 and 30 are opened, and in the state in which the processing chamber 24 and the load lock chamber 28*a* are coupled to each other in terms of vacuum, i.e., in the state in which the state of vacuum of the space from the load lock chamber 28*a* to the processing chamber 24 is maintained, the replacement of the substrate 2 is performed between the processing chamber 24 and the load lock chamber 28*a*. After completion of the replacement of the substrate 2, the both gate valves 26 and 30 are closed, and the space surrounded by the vacuum seal 54 and the like is vented to allow to vacuum seal 54 to shrink, thereby canceling the coupling between the processing chamber 24 and the load lock chamber 28*a*. Next, the load lock chamber 28*a* is moved, and the other load lock chamber 28*b* is moved alongside the processing chamber 24, and the replacement of the substrate 2 is performed between the processing chamber 24 and the load lock chamber 28*b* in the same way as described above.

According to this vacuum processing apparatus, a desired load lock chamber 28*a* or 28*b* between the two load lock chambers 28*a* and 28*b* is moved, that load lock chamber 28*a* or 28*b* and the processing chamber 24 are coupled to each other in the state of being vacuum sealed by the vacuum seal 54, and the substrate 2 can be transported between that load lock chamber 28*a* or 28*b* and the processing chamber 24. Therefore, it becomes unnecessary to provide a transport chamber which has hitherto been required. As a result, the installation area of this vacuum processing apparatus can be made small.

Moreover, although it has hitherto been necessary to transport the substrate via the transport chamber having a substrate transporting mechanism in its interior, and particles (contaminants) are produced from the substrate transporting mechanism and have been likely to adhere to the substrate surface. In this vacuum processing apparatus, however, since the substrate 2 can be transported without via such a transport chamber, it is possible to reduce the particles adhering to the surface of the substrate 2.

This vacuum processing apparatus further has the evacuating section for evacuating the respective load lock chambers 28*a* and 28*b* and the venting section for venting the respective load lock chambers 28*a* and 28*b*. As for these means, means which individually evacuate and vent the load lock chambers 28*a* and 28*b*, respectively, are preferable. Their specific examples are shown in FIGS. 5 and 6.

Figure 5:
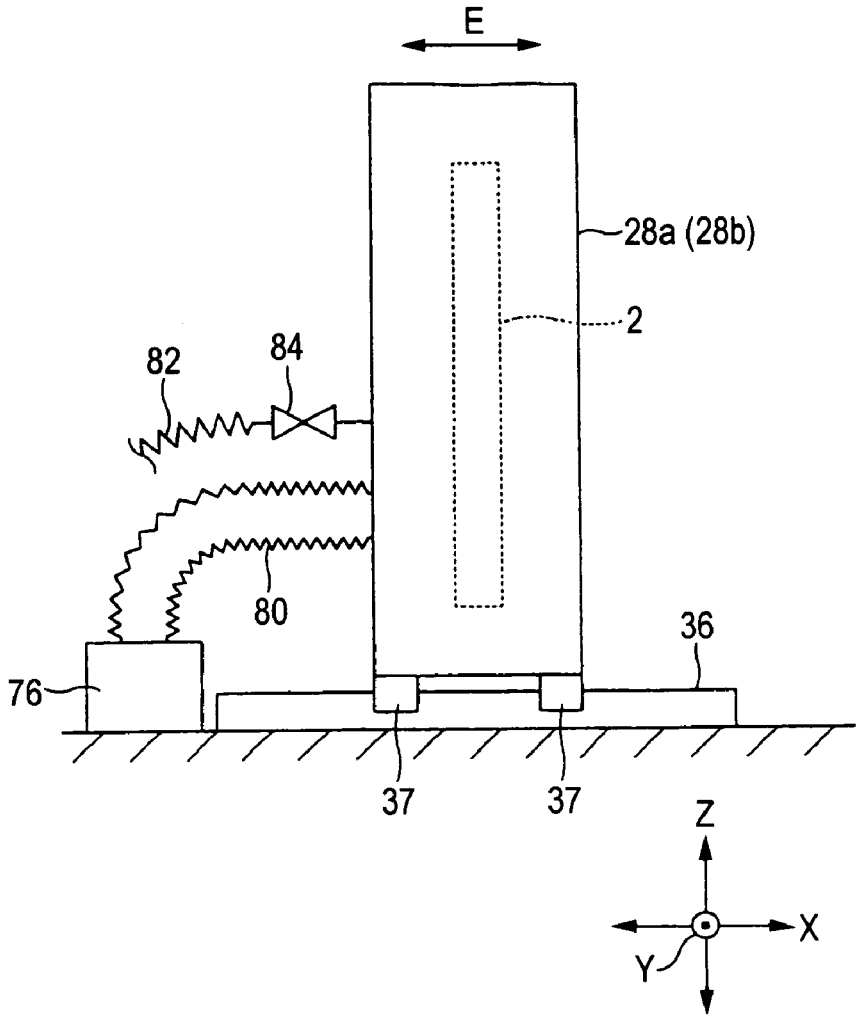
FIG. 5 is a schematic side elevational view illustrating examples of an evacuating section and a venting section of a load lock chamber.

In the example shown in FIG. 5, a vacuum pump 78 is provided on a fixed portion, and that vacuum pump 78 and the load lock chamber 28*a* are connected by a flexible tube 80, thereby forming the above-described evacuating section. Further, an air source (not shown) provided on the fixed portion and the load lock chamber 28*a* are connected by a flexible tube 82 and a vent valve 84, thereby forming the above-described venting section. The flexible tubes 80 and 82 make it possible to cope with the movement of the load lock chamber 28*a* in the Y directions shown by the arrows E. The same applies to the load lock chamber 28*b* side as well.

Figure 6:
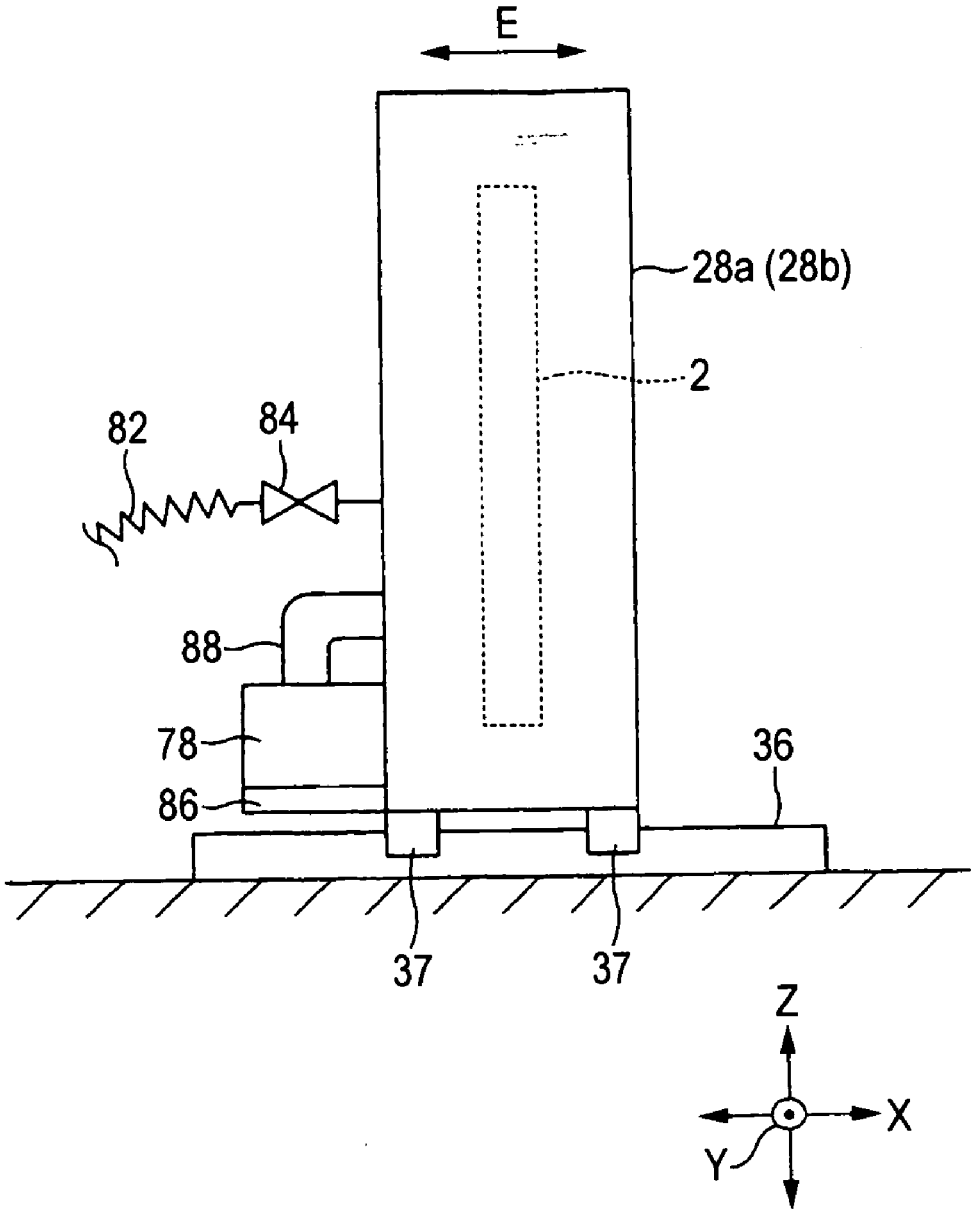
FIG. 6 is a schematic side elevational view illustrating other examples of the evacuating section and the venting section of the load-lock chamber.

In the example shown in FIG. 6, the vacuum pump 78 is installed on the load lock chamber 28*a* by means of a supporting base 86 and the like, and this vacuum pump 78 and the load lock chamber 28*a* are connected by a piping 88, thereby forming the above-described evacuating section. Accordingly, in this example, the vacuum pump 78 moves together with the load lock chamber 28*a*. The venting section is similar to the case of the example shown in FIG. 5. The same applies to the load lock chamber 28*b* side as well.

By providing the above-described evacuating section, the respective load lock chambers 28*a* and 28*b* can be evacuated by the evacuating section during the movement of the respective load lock chambers 28*a* and 28*b*, thereby making it possible to effectively use the time. Accordingly, the effect exerted by the time required for evacuation on the throughput of the vacuum processing apparatus can be made small, making it possible to improve the throughput of the vacuum processing apparatus. By providing the above-described venting section, it is possible to perform the venting of the respective load lock chambers 28*a* and 28*b* during their movement.

By developing the above-described embodiment, three or more movable load lock chambers may be provided with respect to one fixed processing chamber 24. In that case, the preparatory chamber moving mechanism is sufficient if it is capable of moving these load lock chambers individually or in an interlocking relation.

As a method of operating the above-described vacuum processing apparatus, it is possible to adopt various methods. To describe one of such examples with reference to FIG. 1, concurrently as one (e.g., the load lock chamber 28*a*) of the plurality of load lock chambers and the processing chamber 24 are coupled with each other in the state of being vacuum sealed by the vacuum seal 54, and the replacement of the substrate 2 is performed between the both chambers 24 and 28*a*, the respective operations of the venting of that load lock chamber 28*b*, the replacement of the substrate 2 between the load lock chamber 28*b* and the atmosphere, and the evacuation of the load lock chamber 28*b* are performed in one (e.g., the load lock chamber 28*b*) of the remaining load lock chambers.

According to this operating method, since the operation of replacing the substrate 2 between one load lock chamber and the processing chamber 24 and the operation of such as replacing the substrate 2 between another load lock chamber and the atmosphere are performed concurrently, it is possible to reduce wasteful waiting time. In consequence, the throughput of the vacuum processing apparatus improves.

The vacuum processing apparatus in accordance with this invention may have a plurality of fixed processing chambers. The embodiment shown in FIG. 2 has two fixed processing chambers 24*a* and 24*b* respectively corresponding to the above-described processing chamber 24. The processing chamber gate valve 26 and the vacuum seal 54 are respectively installed on each of the processing chambers 24*a* and 24*b*, in the same way as in the case of the above-described processing chamber 24. The relationship between the respective one of the processing chambers 24*a* and 24*b* and the respective one of the load lock chambers 28*a* and 28*b* is similar to the case of the above-described embodiment described with reference to FIG. 1 and the like. Namely, it suffices if each of the processing chambers 24*a* and 24*b* is considered to be the same as the processing chamber 24 shown in FIGS. 1, 3, and 4.

By developing the above-described embodiment, three or more fixed processing chambers may be provided.

In the case of the vacuum processing apparatus having a plurality of processing chambers, it is possible to adopt a more versatile operating method. To describe one of such examples with reference to FIG. 2, concurrently as the respective operations of the venting of that load lock chamber 28*a*, the replacement of the substrate 2 between the load lock chamber 28*a* and the atmosphere, and the evacuation of the load lock chamber 28*a* are performed in one (e.g., the load lock chamber 28*a*) of the plurality of load lock chambers, the operations of carrying out the substrate 2 processed in the one (e.g., the processing chamber 24*a*) of the plurality of processing chambers from that processing chamber 24*a* and of carrying that substrate 2 into another processing chamber (e.g., the processing chamber 24*b*) can be performed by using at least one (e.g., the load lock chamber 28*b*) of the remaining load lock chambers.

According to this operating method, since the operation of such as replacing the substrate 2 between one load lock chamber and the atmosphere and the operation of transporting the substrate 2 between the plurality of processing chambers by using another load lock chamber are performed concurrently, it is possible to reduce wasteful waiting time. In consequence, the throughput of the vacuum processing apparatus improves.

It should be noted that the above-described load lock chambers (e.g., the load lock chambers 28*a* and 28*b*) may be so arranged as to be capable of accommodating a plurality of substrates 2 in their interior. By so doing, since the plurality of substrates 2 can be accommodated in those load lock chambers, it is possible to reduce the frequency at which the load lock chamber is opened to the atmosphere to transport the substrate 2 with respect to the atmosphere, and it is possible to perform the replacement of the substrate 2 with respect to the processing chamber more speedily. Accordingly, it is possible to improve the throughput of the vacuum processing apparatus further.

As the vacuum seal means which is expandable and shrinkable, instead of the above-described vacuum seal 54 it is possible to adopt one in which a packing such as an O-ring is provided at a distal end portion of a bellows which is expanded or shrunk by a linear driving means such as an air cylinder, for example.

Although a description has been given above of the embodiments in which the substrate 2 is handled in the upright state, the invention is not limited to the same, and the substrate 2 may be handled (e.g., is transported) in a substantially prostrate state.

It will be apparent to those skilled in the art that various modifications and variations can be made to the described preferred embodiments of the present invention without departing from the spirit or scope of the invention. Thus, it is intended that the present invention cover all modifications and variations of this invention consistent with the scope of the appended claims and their equivalents.

What is claimed is:

1. A vacuum processing apparatus comprising:

a processing chamber to provide processing to a substrate;

a processing chamber gate valve installed on the processing chamber and capable of allowing the substrate to pass therethrough;

a plurality of movable load lock chambers;

a plurality of preparatory chamber gate valves, each of which is installed on the corresponding load lock chamber and capable of allowing the substrate to pass therethrough;

a preparatory chamber moving mechanism for moving the load lock chambers individually or in an interlocking relation so that the processing chamber gate valve and the preparatory chamber gate valve approach each other or move away from each other;

a vacuum sealing portion which is provided in a peripheral edge portion of the processing chamber gate valve and is expandable and shrinkable, to vacuum seal a gap between the processing chamber gate valve and the preparatory chamber gate valve which are set close to each other during expansion;

a substrate transporting mechanism for transporting the substrate between the processing chamber and the load lock chamber through the both gate valves and the vacuum sealing portion in a state in which the processing chamber gate valve and the preparatory chamber gate valve are set close to each other;

an evacuating section for evacuating each of the load lock chambers; and a venting section for venting each of the load lock chambers.

2. The vacuum processing apparatus according to claim 1, further comprising:

a second evacuating section for evacuating a space surrounded by the vacuum sealing portion is evacuated; and a second venting section for venting that space.

3. The vacuum processing apparatus according to claim 1, further comprising:

a plurality of atmosphere-side gate valves, each of which is provided on a side surface of the corresponding load lock chamber opposite to a side surface thereof where the preparatory chamber gate valve is provided, for partitioning the load lock chamber and the atmosphere.

4. The vacuum processing apparatus according to claim 1, wherein each of the load lock chambers is capable of accommodating a plurality of substrates in its interior.

5. The vacuum processing apparatus according to claim 1, wherein the substrate is transported by being held on a tray for holding the substrate.

6. A method of operating the vacuum processing apparatus according to claim 1, comprising the steps of:

coupling one of the plurality of load lock chambers and the processing chamber in a state of being vacuum sealed by the vacuum sealing portion;

performing an operation of replacing the substrate between the both coupled chambers; and concurrently with the replacing operation, performing, in at least one of the remaining load lock chambers, operations of a venting of the load lock chamber, a replacement of the substrate between the load lock chamber and the atmosphere, and an evacuation of the load lock chamber.

7. A vacuum processing apparatus comprising:

a plurality of processing chambers to provide processing to a substrate;

a plurality of processing chamber gate valve, each of which is installed on the corresponding processing chamber and capable of allowing the substrate to pass therethrough;

a plurality of movable load lock chambers;

a plurality of preparatory chamber gate valve, each of which is installed on the corresponding load lock chamber and capable of allowing the substrate to pass therethrough;

a preparatory chamber moving mechanism for moving the load lock chambers individually or in an interlocking relation so that the processing chamber gate valve and the preparatory chamber gate valve approach each other or move away from each other;

a plurality of vacuum sealing portions, each of which is provided in a peripheral edge portion of the corresponding processing chamber gate valve and is expandable and shrinkable, to vacuum seal a gap between the processing chamber gate valve and the preparatory chamber gate valve which are set close to each other during expansion;

a substrate transporting mechanism for transporting the substrate between the processing chamber and the load lock chamber through the both gate valves and the vacuum sealing portion in a state in which the processing chamber gate valve and the preparatory chamber gate valve are set close to each other;

an evacuating section for evacuating each of the load lock chambers; and a venting section for venting each of the load lock chambers.

8. The vacuum processing apparatus according to claim 2, further comprising:

a second evacuating section for evacuating a space surrounded by the vacuum sealing portion is evacuated; and a second venting section for venting that space.

9. The vacuum processing apparatus according to claim 7, further comprising:

a plurality of atmosphere-side gate valves, each of which is provided on a side surface of the corresponding load lock chamber opposite to a side surface thereof where the preparatory chamber gate valve is provided, for partitioning the load lock chamber and the atmosphere.

10. The vacuum processing apparatus according to claim 7, wherein each of the load lock chambers is capable of accommodating a plurality of substrates in its interior.

11. The vacuum processing apparatus according to claim 7, wherein the substrate is transported by being held on a tray for holding the substrate.

12. A method of operating the vacuum processing apparatus according to claim 7, comprising the steps of:

performing, in one of the plurality of load lock chambers, operations of a venting of the load lock chamber, a replacement of the substrate between that load lock chamber and the atmosphere, and an evacuation of the load lock chamber; and concurrently performing, by using at least one of the remaining load lock chambers, operations of carrying out the substrate processed in the one of the plurality of processing chambers from that processing chamber and of carrying that substrate into another processing chamber.

* * * * *

UNITED STATES PATENT AND TRADEMARK OFFICE

CERTIFICATE OF CORRECTION

PATENT NO. : 7,367,139 B2
APPLICATION NO. : 11/454875
DATED : May 6, 2008
INVENTOR(S) : Yasunori Ando and Masatoshi Onoda It is certified that error appears in the above-identified patent and that said Letters Patent is hereby corrected as shown below:

In claim 8, column 14, line 1, “claim 2,” should read --claim 7,--.

Signed and Sealed this

Fourth Day of November, 2008

JON W. DUDAS
*Director of the United States Patent and Trademark Office*